US007019262B1

(12) United States Patent
Lu

(10) Patent No.: US 7,019,262 B1
(45) Date of Patent: Mar. 28, 2006

(54) ELECTRIC BLANKET WITH DIGITAL TEMPERATURE SENSORS

(76) Inventor: Yi-Jen Lu, No.73, Tung Te St., Kwanmiao Hsiang, Tainan Hsien (TW)

( * ) Notice: Subject to any disclaimer, the term of this patent is extended or adjusted under 35 U.S.C. 154(b) by 0 days.

(21) Appl. No.: 11/024,714

(22) Filed: Dec. 30, 2004

(51) Int. Cl.
*H05B 1/00* (2006.01)

(52) U.S. Cl. ..... 219/212; 219/201

(58) Field of Classification Search ..... 219/212
See application file for complete search history.

(56) References Cited

U.S. PATENT DOCUMENTS

| | | | | |
|---|---|---|---|---|
| 4,031,352 | A * | 6/1977 | Oosterberg | 219/212 |
| 4,277,670 | A * | 7/1981 | Mori et al. | 219/492 |
| 4,277,671 | A * | 7/1981 | Mori et al. | 219/494 |
| 4,455,474 | A * | 6/1984 | Jameson et al. | 392/472 |
| 6,770,854 | B1 * | 8/2004 | Keane | 219/529 |

* cited by examiner

*Primary Examiner*—Thor S. Campbell
(74) *Attorney, Agent, or Firm*—Birch, Stewart, Kolasch & Birch, LLP

(57) ABSTRACT

An electric blanket includes a substrate made of cotton cloth, a heating member mounted on the substrate, a plurality of digital temperature sensors mounted to the heating member at a plurality of positions for detecting temperature of the heating member at the positions and sending signals relating to the temperature of the heating member at the positions and indicating the positions, a temperature protection switch, an electromagnetic radiation interference filter electrically connected to an AC power source, a DC power supply circuit, a display for displaying at least temperature of the electric blanket, a zero-cross detector, a triac electrically connected to the heating member, and a central processing unit. The central processing unit receives and processes the signals from the digital temperature sensors and a feedback signal from the temperature protection switch to control temperature of the electric blanket.

10 Claims, 5 Drawing Sheets

ELECTRIC BLANKET WITH DIGITAL TEMPERATURE SENSORS

BACKGROUND OF THE INVENTION

1. Field of the Invention

The present invention relates to an electric blanket. In particular, the present invention relates to an electric blanket with digital temperature sensors.

2. Description of the Related Art

A typical electric blanket includes at least one heating wire enclosed by polyvinyl chloride (PVC), with a cotton cover enclosing the PVC. When in use, the heating wire generates heat energy to keep the user warm. Nevertheless, the heat energy could not be effectively dissipated, as the heating wire is enclosed by PVC. Dehydration and scald may occur at the user's skin in contact with electric blanket. Further, the heating wire is generally controlled through conventional power control such that the user is apt to be injured due to inappropriate operation.

SUMMARY OF THE INVENTION

In accordance with an aspect of the present invention, an electric blanket comprises a substrate made of cotton cloth, a heating member mounted on the substrate, a plurality of digital temperature sensors mounted to the heating member at a plurality of positions for detecting temperature of the heating member at the positions and sending signals relating to the temperature of the heating member at the positions and indicating the positions, a temperature protection switch electrically connected in series to the heating member, an electromagnetic radiation interference filter electrically connected to an AC power source, a DC power supply circuit electrically connected to the electromagnetic radiation interference filter for converting AC power source into a DC power supply, a display for displaying at least temperature of the electric blanket, a zero-cross detector electrically connected to the DC power supply circuit, a triac electrically connected to the heating member, and a central processing unit electrically connected to the digital temperature sensors, the electromagnetic radiation interference filter, the DC power supply circuit, the zero-cross detector, the triac, and the display.

The central processing unit receives and processes the signals from the digital temperature sensors and a feedback signal from the temperature protection switch to control temperature of the electric blanket.

In an embodiment of the invention, the heating member includes a fiber, a heating wire wound around the fiber, an inner silicon rubber insulating layer covering the fiber and the heating wire, and an outer silicon rubber insulating layer covering the inner silicon rubber insulating layer.

The triac is electrically connected in series to a resistor and a capacitor. A gate of the triac is activated by pulse waves when a voltage of the AC power source is zero. The capacitor effectively isolates DC potential to avoid abnormal heating and to reduce interference from electromagnetic harmonic waves generated during on/off of the triac.

The electric blanket may further comprise a key for converting temperature unit.

The display is a liquid crystal display comprising an EL-backlight empowered by the AC power source by push-pull control.

The heating member is arranged in a winding manner uniformly extending through an area of the substrate. The electric blanket further comprises a cotton strip covering the heating member. The heating member includes two longitudinal sides slightly protruding out of two lateral sides of the cotton strip. The electric blanket further includes a plurality of pairs of through-holes provided on the substrate and respectively located on two sides of the heating member. A plastic tightening strip extends through each of the plurality of pairs of through-holes to fix the cotton strip to the heating member. The electric blanket further includes a cotton covering for covering the substrate, the heating member, and the cotton strips. An outer covering made of velvet for receiving the cotton covering. The velvet is processed to provide a hairy structure. The cotton cloth of the electric blanket absorbs and stores tiny water molecules floating in the air, and the heating member heating the cotton cloth to generate hot, humid air to warm a user's body without causing scalding.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
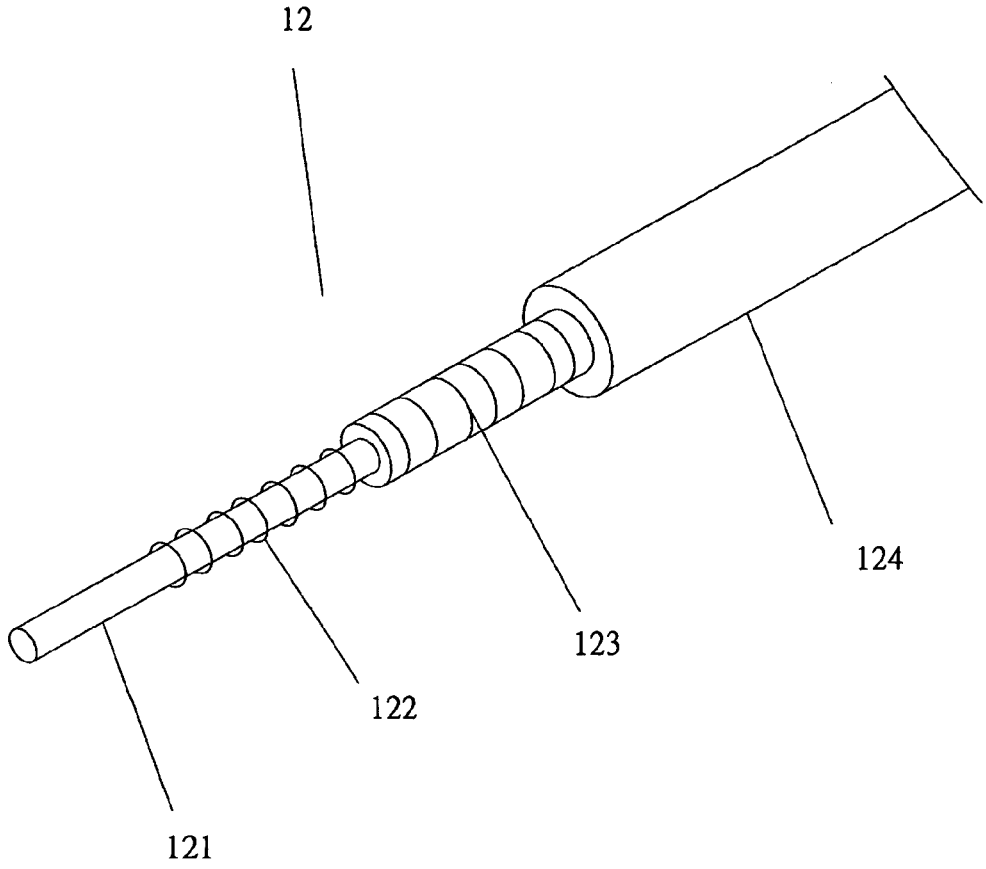
FIG. 1 is a perspective view showing structure of a heating wire of an electric blanket in accordance with the present invention.
Figure 2:
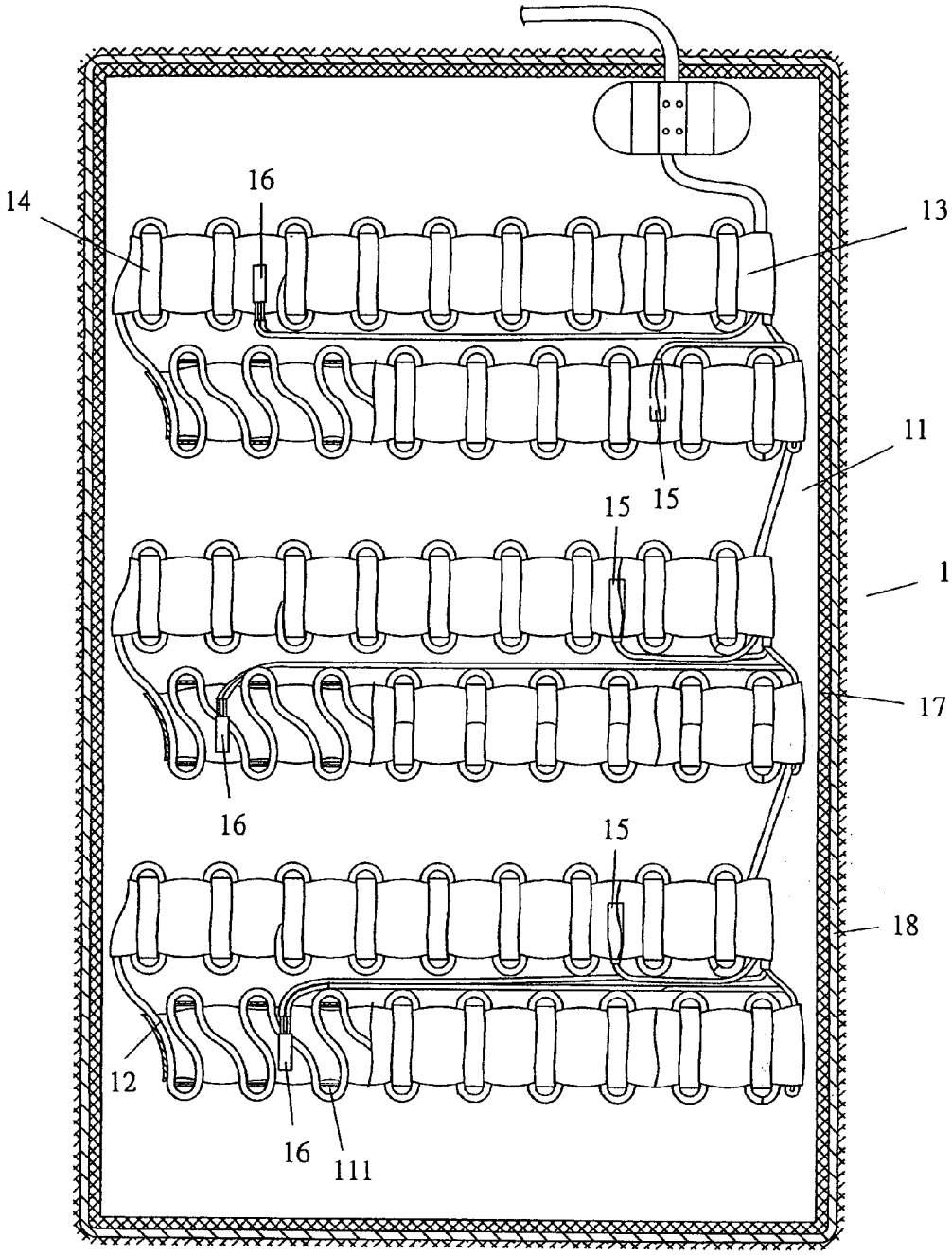
FIG. 2 is a sectional view of the electric blanket in accordance with the present invention.
Figure 3:
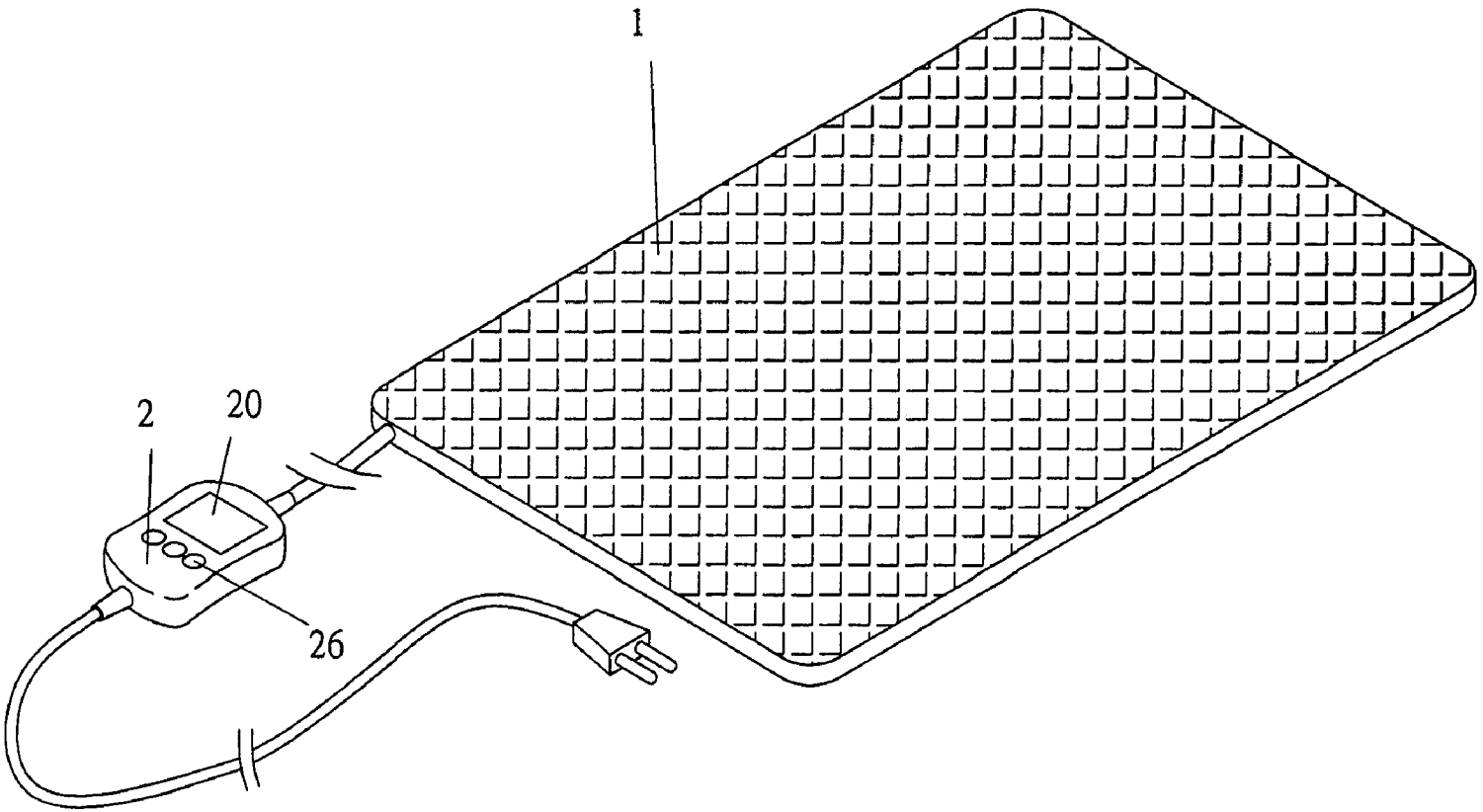
FIG. 3 is a perspective view of the electric blanket in accordance with the present invention.

Referring to FIGS. 1 through 3, an electric blanket 1 in accordance with the present invention comprises a substrate 11 made of cotton cloth that has tenacity and is permeable to air. A heating member 12 is mounted on the substrate 11 and arranged in a winding manner uniformly extending through an area of the substrate 11. The heating member 12 is a safety design covered by two layers of silicon rubber coating. As illustrated in FIG. 1, the heating member 12 includes a fiber 121, a heating wire 122 wound around the fiber 121, an inner silicon rubber insulating layer 123 covering the fiber 121 and the heating wire 122, and an outer silicon rubber insulating layer 124 covering the inner silicon rubber insulating layer 123. Potential injury to the user resulting from electricity leakage is avoided. The heating member 12 is further covered by a cotton strip 13, with two longitudinal sides of the heating member 12 slightly protruding out of two lateral sides of the cotton strip 13. Further, a plurality of pairs of through-holes 111 are provided on the substrate 11 and respectively located on two sides of the heating member 12. A plastic tightening strip 14 is extended through each pair of through-holes 111 to fix the cotton strip 13 to the heating member 12.

A plurality of digital temperature sensors 15 are provided on the heating member 12 and located between the substrate 11 and the cotton strip 13. A temperature protection switch 16 is electrically connected in series to the heating member 12. The digital temperature sensors 15 may indicate their positions. One ore more sets of digital temperature sensors 15 can be connected in parallel. The temperature of the electric blanket 1 can be effectively indicated through use of the digital temperature sensors 15. Abnormal signal interruption can be avoided.

Further, signals from the digital temperature sensors 15 and the power for the heating member 12 can be transmitted through a cable to a digital control circuit of a control box 2 that is external to the electric blanket 1. The control circuit controls the temperature of the electric blanket 1 and thus protects the electric blanket 1 by the signals from the digital temperature sensors 15 and feedback signals from the temperature protection switch 16. The user can be aware of the temperature, time, and other information from a liquid crystal panel or display 20 of the control box 2. The control circuit includes a central processing unit (CPU) 21 with EERAM function to store parameter values. The control box 20 includes a plurality of keys 26 to allow input of the desired temperature, heating time, etc and to allow conversion between temperature units (such as between Celsius and Fahrenheit).

Figure 4:
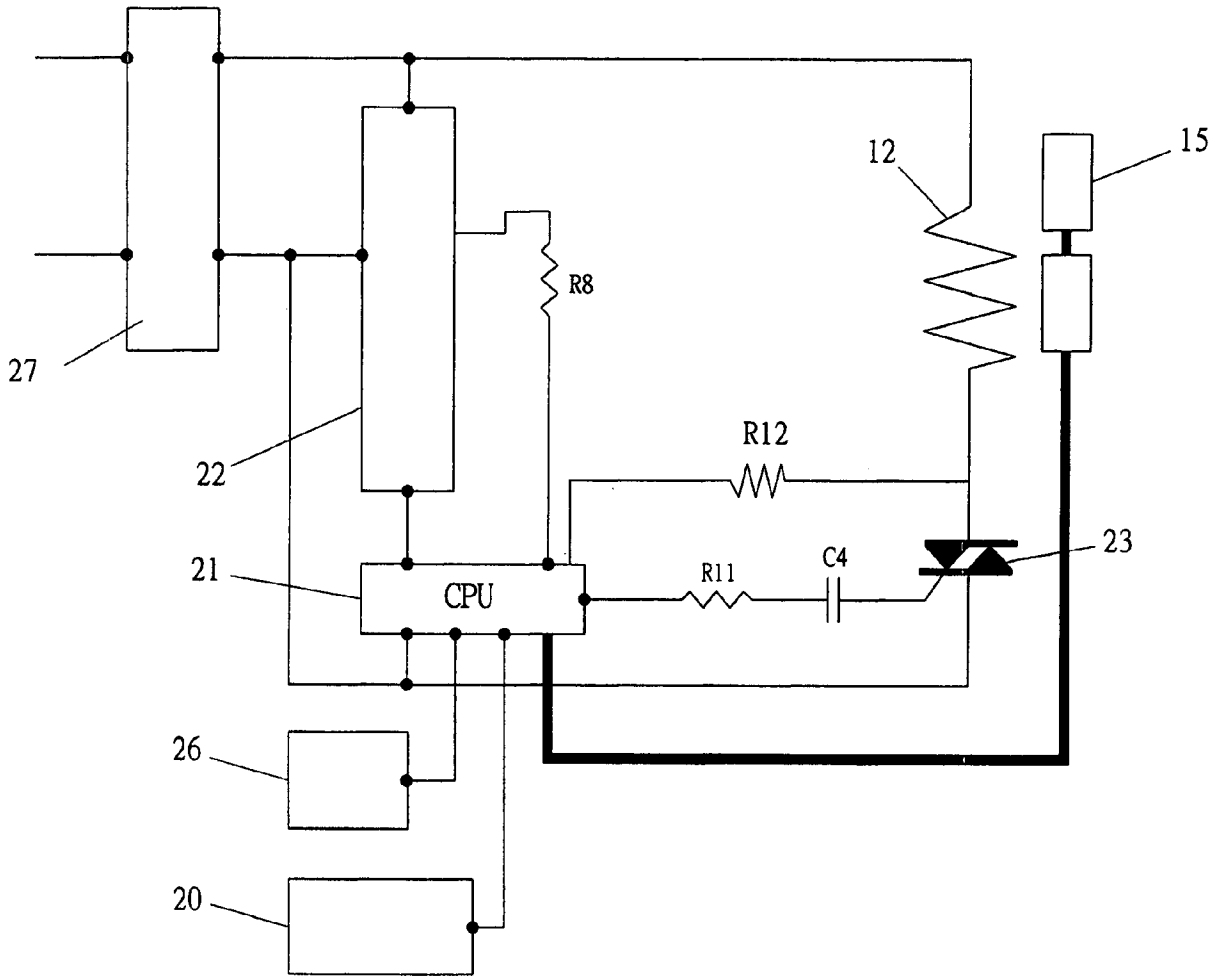
FIG. 4 is a block diagram of a control circuit for controlling the electric blanket.
Figure 5:
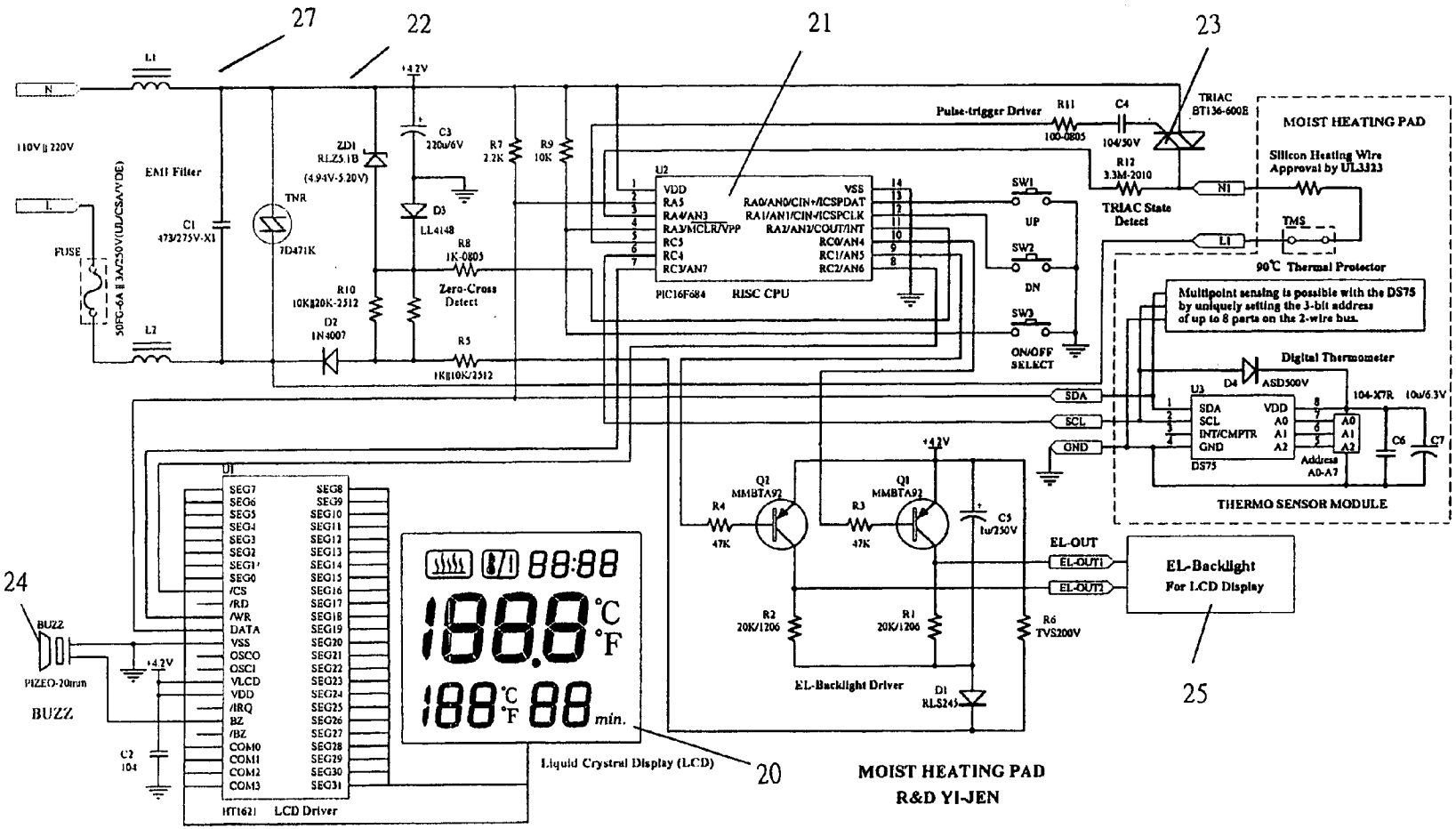
FIG. 5 is a circuitry diagram in accordance with the present invention.

As illustrated in FIGS. 4 and 5, the electric blanket 1 comprises a circuitry including an input end to which a fuse and an electromagnetic radiation interference filterer 27 consisting of two inductors L1 and L2, and a capacitor C1 are mounted. A surge absorber TNR prevents damage resulting from over input voltage. A diode D2 rectifies AC current to obtain high-voltage DC current for the control circuit. The circuitry further includes a voltage-dividing power resistor R10, a Zener diode ZD1 of 5.1V, a filtering capacitor C3, and a biased diode D3.

During positive half cycles of the AC power source, since the diode D2 is biased in the reverse direction, the diode D2 is open. On the other hand, during negative half cycles of the AC power source, since the diode D2 is biased in the forward direction, the diode D2 is closed. The current from the AC power source flows in sequence through a negative (N) end of the AC power source, the inductor L1, the capacitor C3, the diode D3 (or the Zener diode ZD1), the resistor R10, the diode D2, the inductor L2, the fuse, and the L end of the AC power source. This loop makes the current between the anode of the diode D2 and the cathode of the Zener diode ZD1 to be a high-voltage semi-wave DC pulse waves. The voltage of the high-voltage semi-wave DC pulse waves drops after passing through the resistor R10. Then, the voltage is stabilized by the Zener diode ZD1 and the current is filtered by the capacitor C3. After passing through the diode D3, a DC power supply 22 of about 4.3 V is obtained at two ends of the capacitor C3. This DC power supply D2 is supplied to the control circuit.

The circuitry further includes a voltage-dividing resistor R8 that provides zero-cross detection. A pin RA2 of the CPU 21 improves the function of the resistor R8. The CPU 21, the resistor R8, and the DC power supply 22 convert the AC sine wave voltage into digital signals according to the positive and negative half cycles (HI for positive half cycles and LOW for negative half cycles). The CPU 21 processes the digital signals to determine whether to activate a triac 23. During the positive half cycles of the AC power source, since the diode D2 is biased in the reverse direction, the diode D2 is open, as mentioned above. The improvement of the function of the resistor R8 by the pin RA2 of the CPU 21 is enabled when the diode D2 is open. This can be achieved by means of setting software. Since the CPU is HI the diode D3 is biased in the reverse direction and thus deemed as open, and the voltage drop between two ends of the Zener diode ZD1 is zero. Thus, the resistor R8 can be deemed a circuit or zero-cross detector and a HI state can be read from the pin RA2 of the CPU 21.

On the other hand, during the negative half cycles of the AC power source, since the diode D2 is biased in the forward direction and thus closed, the cathode of the diode D3 is about −0.7V when the voltage of the AC power source is greater than the voltage obtained after stabilization by the Zener diode ZD1. A LOW state can be read from the pin RA2 of the CPU 21. An interruption of a subroutine is carried out due to continuous change between HI and LOW at the pin RA2 of the CPU 21.

In a case that enabling of the triac 23 is required, a pin RC5 of the CPU 21 creates HI-LOW-HI-LOW drive pulses that pass through a resistor R11 and a capacitor C4 to activate the triac 23. The triac 23 in a conductive state will become closed when the AC power source is changing from a positive half cycle to a negative half cycle or from a negative half cycle to a positive half cycle. The capacitor C4 isolates the DC potential, preventing the CPU 21 from being down due to noise signals and preventing the triac 23 from becoming conductive due to uncertain state of the pin RC5 of the CPU 21. Thus, since the triac 23 is electrically connected in series to the resistor R11 and the capacitor C4, a gate of the triac 23 is activated by pulse waves when a voltage of the AC power source is zero. The capacitor C4 effectively isolates DC potential to avoid abnormal heating and to reduce interference from electromagnetic harmonic waves generated during on/off of the triac 23.

The circuit further includes a resistor R12 for identifying the state of the triac 23, thereby analyzing whether the triac 23 operates normally. In a case that the triac 23 malfunctions, a buzzer 24 is enabled and thus buzzes, avoiding injury to the user's body and/or damage to objects resulting from improper operation.

The present invention is featured by that the temperature sensors 15 are of digital type with digital transmission function. The anti-noise signal function, the sampling speed, and the resolution of the digital temperature sensors 15 are better than analogue ones. Further, the digital temperature sensors 15 may indicate their positions. Further, one or more sets of digital temperature sensors can be connected in parallel to the same signal bus of the CPU 21.

The circuitry further includes an EL-backlight driver 25 to charge a high-voltage capacitor C5 during negative half cycles of the AC power source, thereby obtaining the energy required for an EL-backlight. Pins RC0 and RC1 of the CPU 21 can be operated to obtain push-pull complimentary output from two transistors Q1 and Q2. Thus, an AC high-voltage output can be obtained at EL-OUT1 and EL-OUT2 of the EL-backlight driver 25 to drive the EL-backlight.

Another feature of the present invention is that the energy for the EL-backlight is directly supplied by the AC power source, unlike ordinary designs of transformers or inductors. The cost is low and the efficiency is high.

The substrate 11 with the heating member 12 and the cotton strips 13 mounted thereon is then covered by a cotton covering 17 that is sealed and then placed into an outer covering 18 made of velvet. Preferably, the surface of the velvet is processed to provide a hairy structure. The electric blanket 1 made of cotton cloth may absorb and store tiny water molecules floating in the air. The heating member 12 heats the cotton cloth to generate hot, humid air to warm the user's body without causing scalding. Further, the electric blanket 1 can be controlled in a digital manner to avoid overheating.

Although the invention has been explained in relation to its preferred embodiment, it is to be understood that many other possible modifications and variations can be made without departing from the scope of the invention as hereinafter claimed.

What is claimed is:

1. An electric blanket comprising:

a substrate (11) made of cotton cloth;

a heating member (12) mounted on the substrate (11), the heating member including a fiber (121), a heating wire (122) wound around the fiber, an inner silicon rubber insulating layer (123) covering the fiber and the heating wire, and an outer silicon rubber insulating layer (124) covering the inner silicon rubber insulating layer;

a plurality of digital temperature sensors (15) mounted to the heating member (12) at a plurality of positions for detecting temperature of the heating member (12) at the positions and sending signals relating to the temperature of the heating member at the positions and indicating the positions;

a temperature protection switch (16) electrically connected in series to the heating member (12);

an electromagnetic radiation interference filter (27) electrically connected to an AC power source;

a DC power supply circuit (22) electrically connected to the electromagnetic radiation interference filter (27) for converting AC power source into a DC power supply;

a display (20) for displaying at least temperature of the electric blanket;

a zero-cross detector (R8) electrically connected to the DC power supply circuit;

a triac (23) electrically connected to the heating member (12); and a central processing unit (21) electrically connected to the digital temperature sensors (15), the electromagnetic radiation interference filter (27), the DC power supply circuit (22), the zero-cross detector (R8), the triac (23), and the display (20);

the central processing unit (21) receiving and processing the signals from the digital temperature sensors and a feedback signal from the temperature protection switch (16) to control temperature of the electric blanket.

2. The electric blanket as claimed in claim 1, with the electric blanket further comprising a key (26) for converting a value of the temperature displayed on the display (20) between centigrade and Fahrenheit.

3. The electric blanket as claimed in claim 1, with the triac (23) being electrically connected in series to a resistor (R11) and a capacitor (C4), with a gate of the triac (23) being activated by pulse waves when a voltage of the AC power source is zero, with the capacitor (C4) effectively isolating DC potential to avoid abnormal heating and to reduce interference from electromagnetic harmonic waves generated during on/off of the triac (23).

4. The electric blanket as claimed in claim 1, with the display (20) being a liquid crystal display comprising an EL-backlight empowered by the AC power source by push-pull control.

5. The electric blanket as claimed in claim 1, with the heating member (12) being arranged in a winding manner uniformly extending through an area of the substrate (11).

6. The electric blanket as claimed in claim 5, with the electric blanket further comprising a cotton strip (13) covering the heating member (12), with the heating member (12) including two longitudinal sides slightly protruding out of two lateral sides of the cotton strip (13).

7. The electric blanket as claimed in claim 6, with the electric blanket further including a plurality of pairs of through-holes (111) provided on the substrate (11) and respectively located on two sides of the heating member (12), with a plastic tightening strip (14) extending through each of said plurality of pairs of through-holes (111) to fix the cotton strip (13) to the heating member (12).

8. The electric blanket as claimed in claim 7, with the electric blanket further including a cotton covering (17) for covering the substrate (11), the heating member (12), and the cotton strips (13), further including an outer covering (18) made of velvet for receiving the cotton covering (17).

9. The electric blanket as claimed in claim 8, with the velvet being processed to provide a hairy structure.

10. The electric blanket as claimed in claim 8, with the cotton cloth of the electric blanket absorbing and storing tiny water molecules floating in the air, with the heating member (12) heating the cotton cloth to generate hot, humid air to warm a user's body without causing scalding.

* * * * *